US012760621B2

(12) United States Patent
Karakaya et al.

(10) Patent No.: US 12,760,621 B2
(45) Date of Patent: Oct. 13, 2026

(54) COOLING WELL FLUIDS USING HYDRO-MOTOR DRIVEN AIR COOLERS

(71) Applicant: Saudi Arabian Oil Company, Dhahran (SA)

(72) Inventors: Mustafa Karakaya, Dhahran (SA); Abdullah Mahdi Al Shehab, Al Qatif (SA); Ibrahim Alanazi, Dammam (SA); Reem Alsadoun, Al Khobar (SA); Almolham Saleh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/011,808

(22) Filed: Jan. 7, 2025

(65) Prior Publication Data

US 2026/0193960 A1 Jul. 9, 2026

(51) Int. Cl.
*E21B 36/00* (2006.01)

(52) U.S. Cl.
CPC ..... *E21B 36/001* (2013.01)

(58) Field of Classification Search
CPC ..... E21B 36/001; E21B 21/06
See application file for complete search history.

(56) References Cited

U.S. PATENT DOCUMENTS

| | | | | |
|---|---|---|---|---|
| 8,109,325 | B2 | 2/2012 | Kroliczek et al. | |
| 9,557,104 | B1 * | 1/2017 | Smith | F25J 3/061 |
| 10,767,893 | B2 | 9/2020 | Karamanos | |
| 2014/0318810 | A1 * | 10/2014 | Lucas | E21B 43/02 166/381 |
| 2017/0292736 | A1 * | 10/2017 | Hjorth | F24F 1/0063 |
| 2021/0032966 | A1 * | 2/2021 | Van Krevel | F04B 47/026 |
| 2021/0277737 | A1 * | 9/2021 | Gregory | E21B 23/14 |

FOREIGN PATENT DOCUMENTS

| | | | |
|---|---|---|---|
| EP | 1148772 | A2 | 10/2001 |
| EP | 3320288 | B1 | 12/2020 |

* cited by examiner

*Primary Examiner* — Giovanna Wright
(74) *Attorney, Agent, or Firm* — Dinsmore & Shohl LLP

(57) ABSTRACT

A method of cooling wellbore fluids using hydromotor driven air cooler includes flowing wellbore fluid received from a wellhead of a wellbore through a hydromotor to generate torque and rotation. The wellbore fluid exiting the hydromotor is flowed through a heat exchanger network that includes multiple pipes arranged to exchange heat of the wellbore fluid with air flowed past an outer surface of the heat exchanger network. Using the torque and rotation generated by flowing the wellbore fluid through the hydromotor, an air blowing system is operated to generate air. The generated air is directed to flow past the outer surface of the heat exchanger network.

16 Claims, 6 Drawing Sheets

COOLING WELL FLUIDS USING HYDRO-MOTOR DRIVEN AIR COOLERS

TECHNICAL FIELD

This disclosure relates to wellbore operations and specifically to cooling wellbore fluids produced from wellbores.

BACKGROUND

The process of hydrocarbon production begins with the formation of wellbores in subterranean zones. The wellbores allow for the extraction of hydrocarbons, which are then transported through wellheads to downstream refineries for processing. The conditions under which these operations occur are often extreme, with high pressure and temperature influencing both the formation and the produced fluids. Especially after hydraulic fracturing operations, large volume of fracture water flows to surface from fractured zones. The high pressure and temperature not only affects the characteristics of the hydrocarbons but also poses challenges in terms of equipment and safety measures required to handle such hot and pressurized substances efficiently and safely.

SUMMARY

This specification describes technologies relating to cooling well fluids using hydro-motor driven air coolers.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
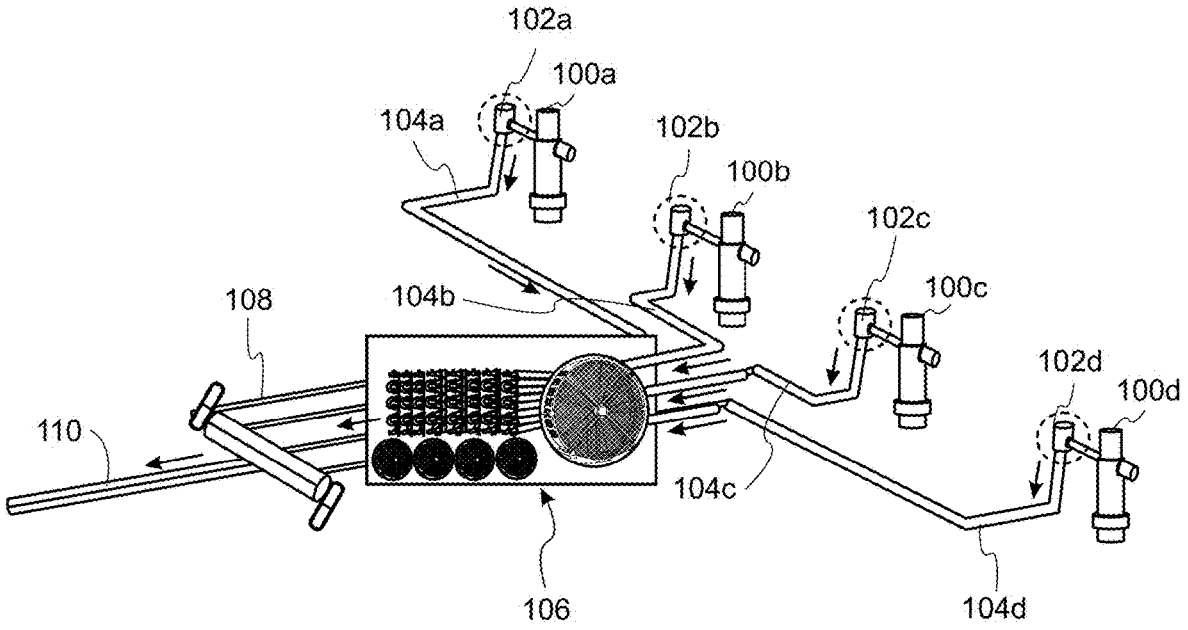
FIG. 1 is a schematic diagram showing cooling wellbore fluids received from multiple wellheads.

Hydrocarbons (e.g., petroleum, natural gas or combinations of them) residing in subsurface reservoirs are raised (i.e., produced) to the surface by forming wellbores. Such wellbores run from the surface to the subsurface reservoirs through subterranean zones. A subterranean zone can be a formation, a portion of a formation or multiple formations. Subterranean zones include rock formations under high temperature and pressure. Hydrocarbons produced from subterranean zones are also under high temperature and pressure. Safe and efficient production of hydrocarbons involves managing the temperature and pressure of hydrocarbons.

Hydrocarbons flow through a wellbore to the surface of the wellbore, specifically to a wellhead installed at the surface of the wellbore. The fluids received at the wellhead are then flowed to downstream facilities such as refineries. Flowlines such as carbon steel pipes can be used to flow such high-pressure, high-temperature fluids. Reinforced thermoplastic pipes (RTP) are sometimes used as alternatives to mitigate corrosion issues. Sometimes, the pipes used to flow the fluids may have temperature limitations.

This disclosure describes implementing heat exchanger systems to reduce the temperature of the reservoir fluids received from the wellhead before the fluids enter the flowlines. This disclosure also describes powering the heat exchanger systems using the energy of reservoir fluid flow. In some implementations, the reservoir fluids are flowed through one or more hydromotors to generate rotation and torque. The rotation and torque can be utilized to drive surface air cooling systems to further cool the fluids.

Implementing the techniques described here can offer one or more of the following advantages. The wellbore fluid cooling system described here can serve as an alternative or a replacement for cooling systems that need to be powered by external power sources such as a generator set, solar power systems or other electric or hydraulic oil source. Compared to other cooling systems, the wellbore fluid powered cooling system described here has a smaller foot print. The wellbore fluid cooling system described here has a cost-effective, air-cooling setup that is compact and easy to install. The cooling system can be on the skid or truck mounted setups. All system together with all auxiliary equipment can be mobile and easy to transfer from one location to another as a single piece. Consequently, man power to operate and requirements to maintain the cooling system are decreased. The wellbore cooling system described here allows using or reusing tubing that is used in oil and gas well production. The cooling system uses simple components like standard fans and atmospheric air. The cooling system described here can easily be integrated into or retrofitted with more complex equipment (e.g., air conditioning units) based on cooling needs of the wellbore fluid. The system will have external power outlet to power up some other equipment, and can generate more power than necessary power usage for just cooling system. During the initial phase of production, wellbore fluid flow rates and pressures are high. The energy in the fluids can be harvested by this cooling system and, in some instances, used to power up other, nearby equipment.

FIG. 1 is a schematic diagram showing cooling wellbore fluids received from multiple wellheads. For example, FIG. 1 shows four wellheads (e.g., wellheads 100*a*, 100*b*, 100*c*, 100*d*). The techniques described here can work with more wellheads or fewer (as few as one) wellheads. Each wellhead is installed at an entrance to a wellbore that is formed through a subterranean zone. The wellbore extends from the surface of the Earth to a subterranean reservoir in which wellbore fluids (e.g., hydrocarbon fluids such as petroleum, natural gas, mixed water with oil and gas, or combinations of them) reside. Well completions can be installed within the wellbore to produce the wellbore fluids.

The temperature of the wellbore fluids received at the respective wellheads can be high (e.g., in a range of between 80° C. and 170° C.). The high temperature can be due to temperatures of the deep subterranean zones. The high temperature can also be due to high temperatures of injection fluids injected into the subterranean zone to sweep the wellbore fluids towards the wellbores and eventually towards the wellheads.

Each wellhead includes a system of valves, spools and other well equipment that allow controlling a pressure of the wellbore fluids that exit the wellbore. One such equipment is a choke valve (e.g., choke valves 102*a*, 102*b*, 102*c*, 102*d*) per wellhead. The choke valve can be operated to control a pressure and rate of the wellbore fluids that are flowed from the wellhead to locations downstream of the wellhead.

Multiple flowlines (e.g., flowlines 104*a*, 104*b*, 104*c*, 104*d*) can be fluidically connected to the wellheads; a flowline per wellhead. A flowline can be an elongated tubular. In particular, the flowline can be made of a material that can withstand the high temperature at which the wellbore fluids flow to the wellhead. The material can also withstand the corrosive nature of the wellbore fluids. In some implementations, the flowlines that receive the wellbore fluids from the wellheads can be made of carbon steel. Each flowline can be fluidically connected to the wellhead to receive wellbore fluids from the wellhead and to flow the wellbore fluids to downstream locations.

The multiple flowlines can flow wellbore fluids from respective wellheads to a wellbore fluid cooling system 106 described in more detail with reference to the following figures. The cooling system 106 can cool the wellbore fluids to a temperature that is lower than the temperature at which the wellbore fluids are received at the wellheads. In addition, the cooling system 106 can be operated using power generated using the wellbore fluids themselves. That is, no other power source, other than the wellbore fluids, is needed to power the cooling system 106 to perform the operations described here. The cooling system 106 can serve every single well separately. Alternatively, multiple wells can connect to a single manifold system and all well fluids can be cooled with a single cooling system.

As described later, the cooling system 106 can include HX network that includes multiple pipes fluidically connected to the multiple flowlines. The HX network can cool the wellbore fluids by exchanging heat of the wellbore fluids with ambient air flowed past an outer surface of the HX network. Also, as described later, the cooling system 106 can include an air blowing system that can generate and circulate air past the outer surface of the HX network to improve the heat transfer between the wellbore fluids and the generated/circulated air. The HX network can include one heat exchanger or multiple (i.e., two or more) heat exchangers arranged as a tandem.

The wellbore fluid, which has been cooled by the cooling system 106, can exit the HX network and flow into one or multiple flowlines 108 fluidically connected to the HX network. The flowlines 108 can be substantially identical to the flowlines 106. The flowlines 108 can be fluidically connected to RTP lines 110. The cooled wellbore fluid can flow from the flowlines 108 to the RTP lines 110, and be transported to downstream locations such as gas oil separation plants (GOSPs) or crude oil refineries.

Figure 2:
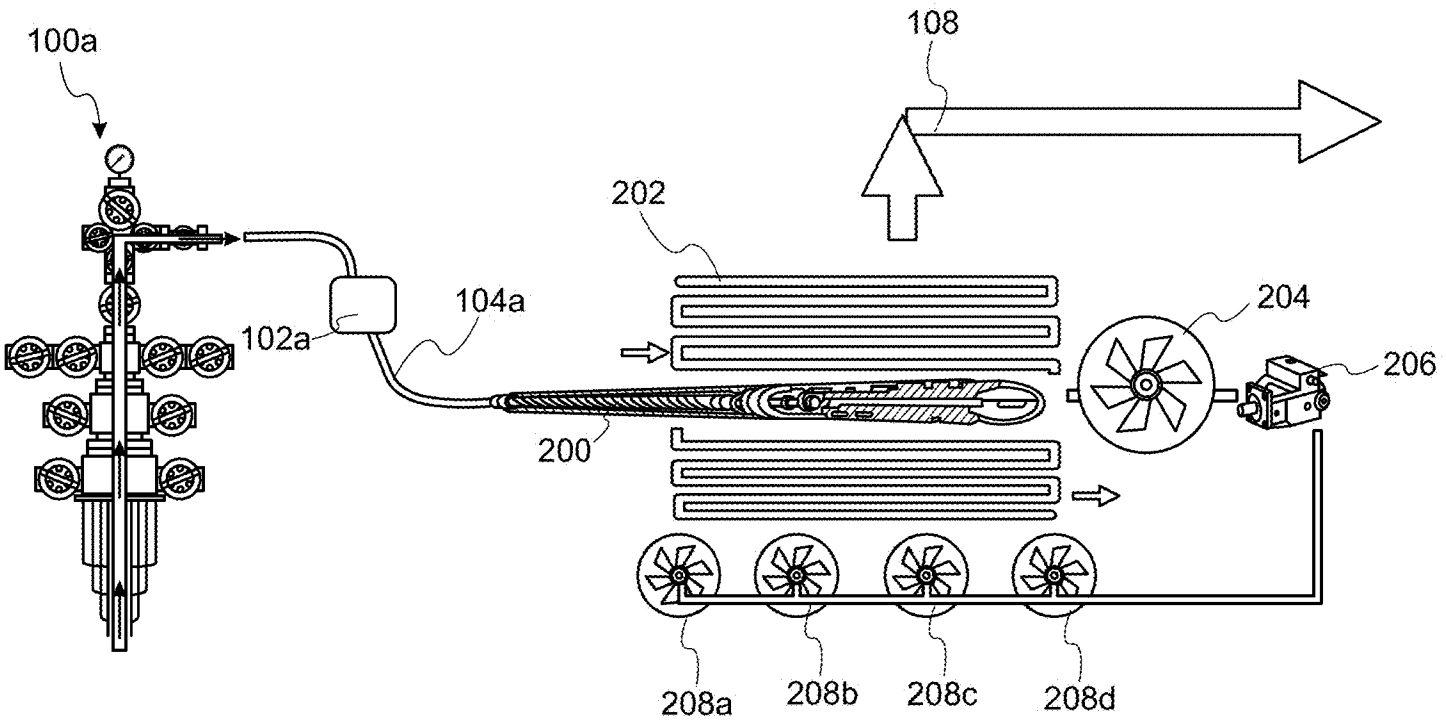
FIG. 2 is a schematic diagram showing cooling wellbore fluids using a heat exchanger (HX) network and an air blowing system.

FIG. 2 is a schematic diagram showing cooling wellbore fluids using a wellbore fluid cooling system that includes a heat exchanger (HX) network and an air blowing system. As an example, the HX network and the air blowing system receive wellbore fluid from the wellhead 100*a*. However, the HX network and the air blowing system can receive the wellbore fluid from any or all of the other wellheads in any combination.

The wellbore fluid cooling system includes a hydromotor 200 that is fluidically connected to the flowline 104*a* downstream of the choke valve 104*a* and upstream of the HX network 202. For example, an inlet of the hydromotor 200 can be fluidically connected to an outlet of the flowline 102*a*. The hydromotor 200 is a fluid flow-driven stator-rotor system that can use fluid energy to generate rotation and torque. The hydromotor 200 receives wellbore fluid from the wellhead 100*a* through the flowline 102*a*. In response to the wellbore fluid flowing through the hydromotor 200, the hydromotor 200 generates rotation and torque. As described later, the hydromotor 200 includes a shaft that rotates in response to the wellbore fluid flowing through the hydromotor 200. The hydromotor 200 can generate rotation and torque in response to flow of single phase fluid (e.g., only liquid or only gas) or multiphase fluid (e.g., including liquid and gas). That is, wellbore fluid can flow through the hydromotor 200 without needing to be separated by phase. For example, the hydromotor 200 can implement metal-to-metal rotor-stator systems instead of metal rotor with elastomer stator to allow rotation using only gaseous phase. In some implementations, a gas-oil separator can be deployed to separate the wellbore fluids into liquid and gaseous phases such that only the liquid phase is flowed through the hydromotor 200 while the gaseous phase is re-routed around the hydromotor 200. In such implementations, a filter can also be deployed to remove any solid in the wellbore fluids.

As mentioned above, the HX network 202 is downstream of the hydromotor 200. The hydromotor 200 is fluidically connected to the HX network 202. The HX network 202 includes multiple pipes (described later). An outlet of the flowline hydromotor 200 is fluidically coupled to an inlet of the pipes. In some implementations, the HX network can have multiple inlet pipes or single continuous pipe setup to receive the wellbore fluid. The outlet of the hydromotor 200 can be fluidically connected in parallel to all of the multiple inlet pipes. In some implementations, multiple hydromotors can be fluidically connected to the outlet of the flowline 102*a*. Each hydromotor can be fluidically connected to each of the inlet pipes. Each hydromotor can be coupled to a respective shaft that can rotate in response to flow of the wellbore fluid through each hydromotor. In this manner, multiple smaller hydromotors can be used in place of a single, large hydromotor when production flow rates are too high for the single, large hydromotor to handle. As the wellbore fluid flows through the multiple pipes of the HX network 202, the wellbore fluids exchange heat with ambient air that flows past the outer surface of the multiple pipes in the HX network 202. Consequently, a temperature of the wellbore fluid decreases.

The air blowing system is coupled to the hydromotor 200. For example, the shaft, which rotates in response to wellbore fluid flowing through the hydromotor 200, is mechanically coupled to the air blowing system. The air blowing system generates air using the rotation of the shaft. In the context of this disclosure, generating air means increasing a flow rate or flow velocity of ambient air to promote air flow and blowing. The air blowing system is spatially arranged with respect to the HX network 202. The arrangement is such that the air generated by the air blowing system flows through the HX network 202. Specifically, the generated air flows past the outer surface of the HX network 202 and improves heat exchange with the wellbore fluid.

In some implementations, the air blowing system includes a fan 204 that is coupled to the hydromotor 200. In particular, the shaft of the hydromotor 200 is mechanically coupled to the fan 204 causing the fan 204 to rotate. For example, the shaft of the hydromotor 200 can be coupled to a shaft of the fan 204. In some implementations, the shafts can be coupled directly such that the shaft of the fan 204 rotates at the same rotational speed as the shaft of the hydromotor 200. In some implementations, a gear system can be implemented between the shaft of the hydromotor 200 and the shaft of the fan 204 causing the fan 204 to rotate at rotational speeds different from the shaft of the hydromotor 200. Propellers (or blades) can be attached to the shaft of the fan 204. The propellers can rotate with the shaft of the fan 204. The rotating fan 204 generates air 204. The fan 204 is spatially positioned to flow the generated air through the HX network 202.

In some implementations, the air blowing system includes a hydropump 206 that is coupled to the shaft. For example, the shaft can be coupled directly to the hydropump 206 in parallel with the fan 204. Alternatively, the shaft can be coupled in series with the hydropump 206 and the fan 204. The hydropump 206 can use the mechanical rotation of the shaft to generate air. For example, a rotation of the shaft can cause a rotation of the hydropump 206. In turn, the rotating hydropump 206 can draw ambient air to generate air blowing. As described below, the hydropump 206 can also be spatially arranged with respect to the HX network 202 to flow the air blowing through the HX network 202. In this manner, both the air generated by the fan 204 and the air blowing generated by the hydropump 206 can be used to exchange heat with the wellbore fluids.

In some implementations, the air blowing system includes multiple fans (e.g., fans 208*a*, 208*b*, 208*c*, 208*d*), which are smaller in size than the fan 204. The smaller size causes the multiple fans to generate air at a lower flow rate than the fan 204. The multiple fans can be coupled to the hydropump 206 or to the fan 204 or both. The rotation of the hydromotor 200 causes the hydropump 206 to energize the hydraulic fluid. The energized hydraulic fluid can drive the multiple fans. Excess hydraulic fluid can be collected in a hydraulic fluid container (described later). The multiple smaller fans can also be spatially arranged with respect to the HX network 202 to further flow air through the HX network 202 and exchange heat with the wellbore fluids. For example, some of the fans can be positioned at the bottom of the HX network 202 to flow air in a vertically upward direction. Some of the fans can be positioned at the top of the HX network 202 to flow air in a vertically downward direction. Similarly, fans can be positioned on the front/back and to the left/right of the HX network 202 to circulate air in multiple directions past the HX network 202. The cooled wellbore fluids exit the HX network 202 through the flowline 108.

In some implementations, each of the hydromotor, the HX network and the air blowing system can be positioned upstream of the choke valve, before the GOSP and after the choke valve, or after the GOSP depending on the wellhead pressure and wellbore fluid types.

Figure 3:
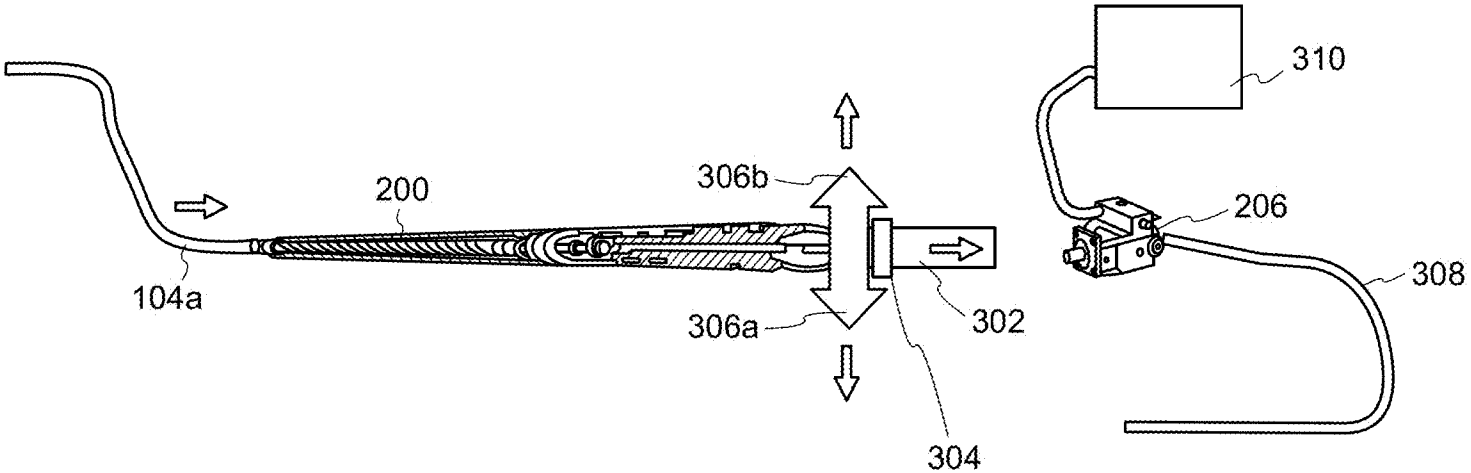
FIG. 3 is a schematic diagram showing the hydromotor converting wellbore fluid flow into a mechanical rotation to generate torque.

FIG. 3 is a schematic diagram showing the hydromotor 200 converting wellbore fluid flow into a mechanical rotation to generate torque. As described above, the wellbore fluids are flowed to the hydromotor 200 through the flowline 104*a* (or other flowlines fluidically connected to the wellhead). The hydromotor 200 can convert hydraulic energy of the flowing wellbore fluid into mechanical energy in the form of torque. The hydromotor 200 is coupled to a shaft 302 that rotates due to the torque. In some implementations, the shaft 302 and the hydromotor 200 (specifically, an outlet of the hydromotor 200) are coupled by a staffing box and bearing system 304 that isolates the wellbore fluids and allows the shaft 302 to rotate. In some implementations, different bearing systems can be used to increase the number of turns and adjust the torque for rotation to directly couple to the cooling fan 204 of the hydropump 206. The hydromotor 200 defines outlets (e.g., outlets 306*a*, 306*b*) through which the wellbore fluids exit the hydromotor 200 and flow to the HX network 202 as described earlier.

In some implementations, the shaft 302 is mechanically coupled to the hydropump 206. The rotation of the shaft 302 causes the hydropump 206 to rotate. In response to the rotation, the hydropump 206 draws ambient air and generates air blowing. A pipe or tube 308 can be coupled to the hydropump 206 to direct the air blowing. For example, the pipe, hose or tube 308 can be pointed toward the HX network 202 to flow the air blowing through the HX network 202 to aid in exchanging heat with the wellbore fluid flowed through the HX network 202. In some implementations, a hydraulic fluid container 310 can be connected to the hydropump 206. Lubricant carried in the container 310 can be flowed to the hydropump 206 during operation of the hydropump 206. In addition, the hydropump 206 draws hydraulic lubricant from the container 310 and energizes the hydraulic fluid. As described earlier, the energized hydraulic fluid is used to power the air fans. The energized hydraulic fluid is flowed through hoses or metal tubes.

Figure 4:
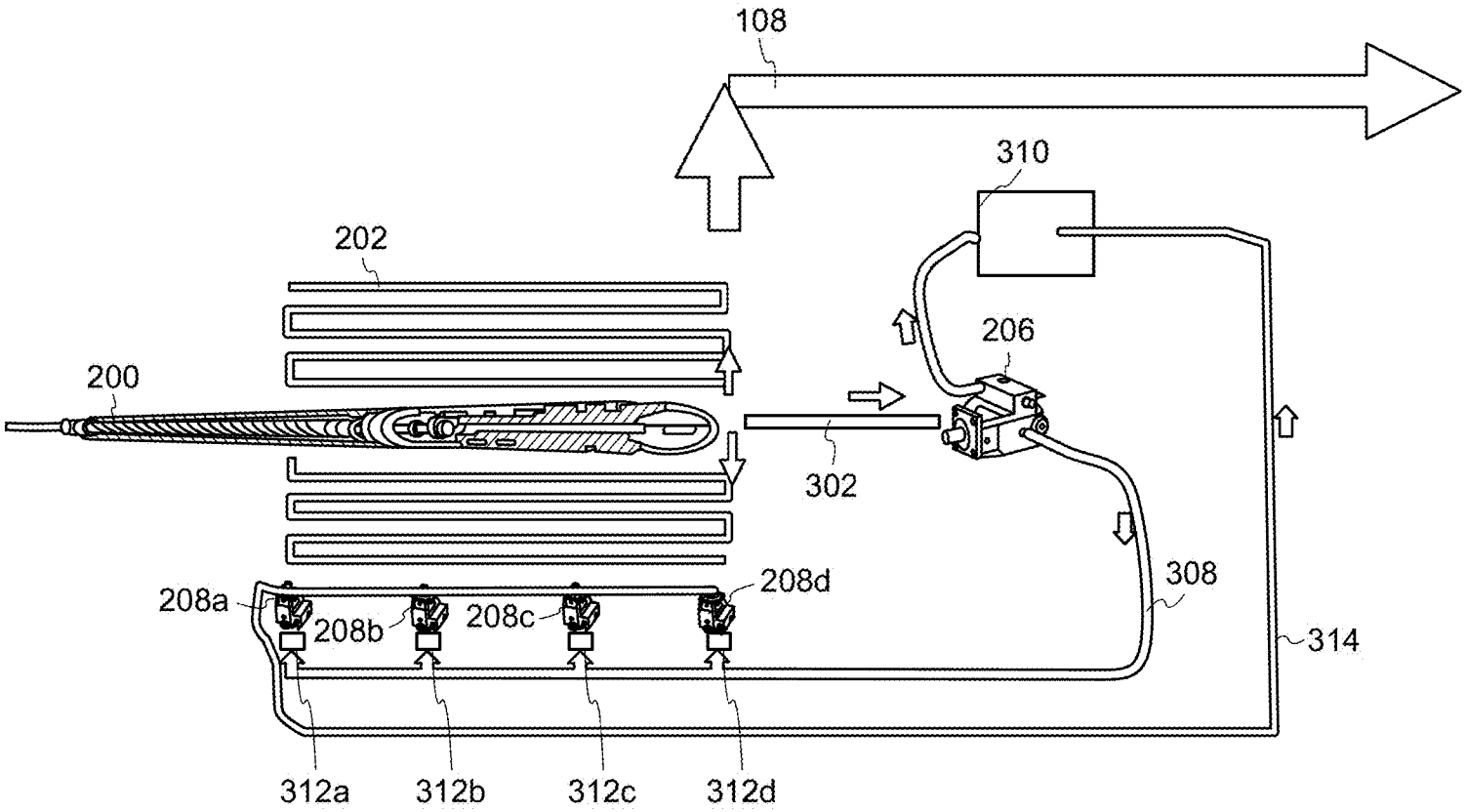
FIG. 4 is a schematic diagram showing the hydropump powering multiple fans.

FIG. 4 is a schematic diagram showing the hydropump 206 powering multiple fans (e.g., the fans 208*a*, 208*b*, 208*c*, 208*d*). As described above, the wellbore fluids are flowed to the hydromotor 200 through the flowline 104*a* (or other flowlines fluidically connected to the wellhead). The hydromotor 200 can convert hydraulic energy of the flowing wellbore fluid into mechanical energy in the form of torque. The hydromotor 200 is coupled to a shaft 302 that rotates due to the torque. The hydromotor 200 defines outlets (e.g., outlets 306*a*, 306*b* shown in FIG. 3) through which the wellbore fluids exit the hydromotor 200 and flow to the HX network 202. The shaft 302 is mechanically coupled to and rotates the hydropump 206, in response to which the hydropump 206 draws ambient air and generates air blowing. A pipe, hose or tube 308 can be coupled to the hydropump 206 to direct the air blowing. In some implementations, hydropump 206 is used to power the multiple fans (e.g., the fans 208*a*, 208*b*, 208*c*, 208*d*). For example, the high pressure air carried by the pipe, hose or tube 308 can be coupled to the multiple fans and can drive the fans to rotate.

Alternatively, the hydropump 206 is fluidically connected to a hydraulic fluid container 310 filled with hydraulic fluid. When the hydropump 206 is rotated by the hydromotor 200, the hydropump 206 draws the hydraulic fluid from the container 310 and energizes (i.e., increases the pressure of) the hydraulic fluid. The hydropump 310 then flows the energized hydraulic fluid to the fans through the pipe, hose or tube 308 to drive the fans or to drive other downstream devices. To do so, each of the multiple fans is connected to a respective hydromotor (e.g., hydromotors 312*a*, 312*b*, 312*c*, 312*d*). Each of the hydromotors 312*a*, 312*b*, 312*c*, 312*d* can be substantially similar to the hydromotor 200 in operating principle, and can be sized to power the respective fan to which each is connected. Each of the hydromotors 312*a*, 312*b*, 312*c*, 312*d* receives the energized hydraulic fluid through the pipe, hose or tube 308 and converts the hydraulic (or pneumatic) energy of the air blowing to a mechanical rotation. Excess hydraulic fluid can flow back to the hydraulic fluid container 310 through the return line 314, which can be a pipe, hose or tube.

For example, each of the hydromotors 312*a*, 312*b*, 312*c*, 312*d* can be connected to a respective shaft that is mechanically coupled to a respective fan. Each shaft can rotate in response to the air blowing flowing through the respective hydromotor. The rotating shaft can rotate propellers (or blades) of the fan to generate air. The fans 208*a*, 208*b*, 208*c*, 208*d* can be spatially arranged with respect to the HX network 202 to circulate air and facilitate heat exchange with the wellbore fluid. In some cases, small hydromotors directly connect to air fan or use gear box to establish rotation. Some cases instead of hydromotors it is possible to use electric motor if main rotation shaft 302 connect and power up generator. As described above, the wellbore fluid flowed through and cooled within the HX network 202 flows into the flowline 108 and towards the RTP line 110 (not shown).

Figure 5:
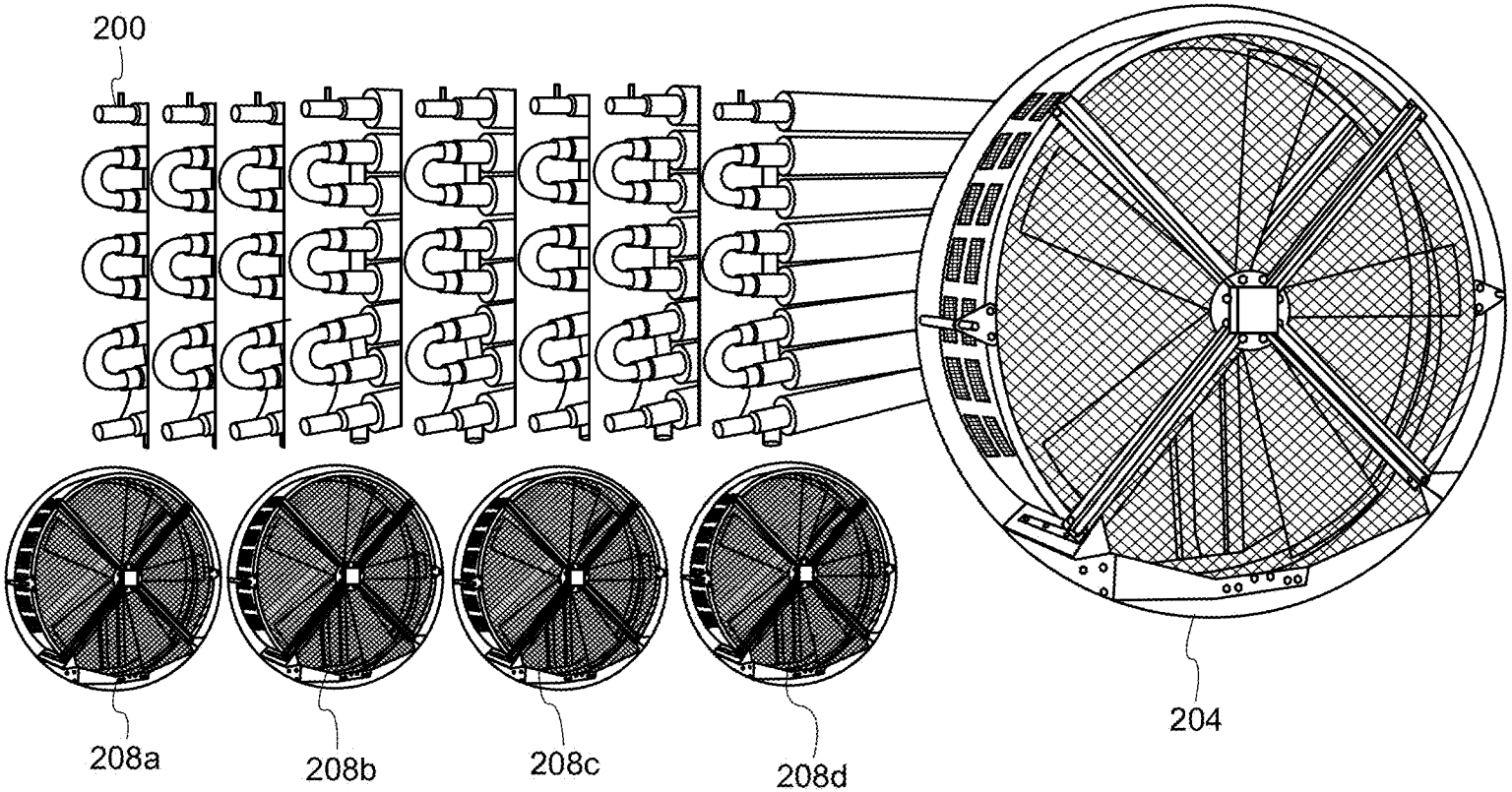
FIG. 5 is a schematic diagram showing components of the wellbore fluid cooling system.

FIG. 5 is a schematic diagram showing components of the wellbore fluid cooling system. As described above, the wellbore fluid cooling system includes the HX network 202. The HX network 202 includes multiple pipes or a network of pipes fluidically connected to each other. The multiple pipes can be arranged, for example, in a serpentine arrangement in both the vertical (columns) and horizontal dimensions (rows). Such an arrangement allows the wellbore fluid to run in one direction and then reverse direction, thereby improving heat exchange.

Pipes in successive rows or columns can be spaced apart to allow cooling fluid (e.g., air) to flow past the outer surface of the pipes. The spaces can be introduced by arranging the pipes on racks positioned between the pipes. The serpentine space and the spacing can be selected to maximize the cross-sectional area of the pipes over which the air can flow. Such maximizing can increase a heat exchange efficiency of the HX network 202. The ends of the pipes in the HX network 202 can include flexible tubing to establish fluidic connections with other tubulars such as the flowlines 102, 104, and the like. The flexible connections can be made from metal elbows or hoses, for example. The pressure and rate limitation of the flexible connections can be the same as that of the pipes in the HX network 202.

In some implementations, a manifold can be implemented to receive the flowline 102 at an inlet and to provide multiple outlets, each connected to a respective pipe inlet through a respective flexible connection. Multiple manifolds with different numbers of inlets and outlets can be deployed to couple the flowline 102 to the HX network 202, and separately to couple the HX network 202 to the flowline 108. In some implementations, flow rate diverters or valves can be used to guide the wellbore fluid towards some pipes or away from some pipes or both. For example, instead of flowing all of the wellbore fluid into a single and continuous pipe setup, arrangement of manifolds and diverters/valves can flow the wellbore fluid into multiple pipes of the HX network 202. Doing so can reduce the wellbore fluid flow rate or increase the total flow time if use single continuous setup through the HX network 202. The reduced flow rate increases the time spent by the wellbore fluid in the HX network 202, thereby improving heat exchange with the circulated air.

In some implementations, the bottoms of the racks used to separate the pipes can have holes/gaps for air flow from bottom to upper part of the pipes (could be at bottom, at top and also between the pipes). Multiple pipe separators (e.g., 2-150 pipe separators) can be implemented between the pipe for each layer. The pipes can include finned tube heat exchanger pipes, which offer additional surface area for better heat exchange. A gap can be left between the separators to allow better air blowing. The pipe separators separate the pipe horizontally and vertically. The separators can be made from metal for better heat transfer, or can be made from non-heat conductive materials like wood, plastic or composites. Using the separators, the pipes are arranged to not touch each other on the drum.

The metallurgy of the pipes can be selected based on the well fluid types, oil and gas composition, and other factors. For example, for wellbore fluids with higher concentrations of hydrogen sulfide ($H_2S$) and carbon dioxide ($CO_2$), low alloy steels may be used. The pipe thickness can be selected based on flow requirements and corrosion tendencies. The length of each tube can be between 1 meter (m) and 15 m based on the cooling requirement.

The wellbore cooling fluid system also includes the fan 204, which serves as the primary fan driven by the hydromotor 200. The fan 204 can have a diameter between 0.5 meters and 3 meters. The wellbore cooling fluid system also includes the multiple fans 208 *a*, 208*b*, 208*c*, 208*d*, which can be smaller in size compared to the fan 204. Such a difference in dimension allows to position each of the multiple fans at different locations within the HX network 202.

Figure 6:
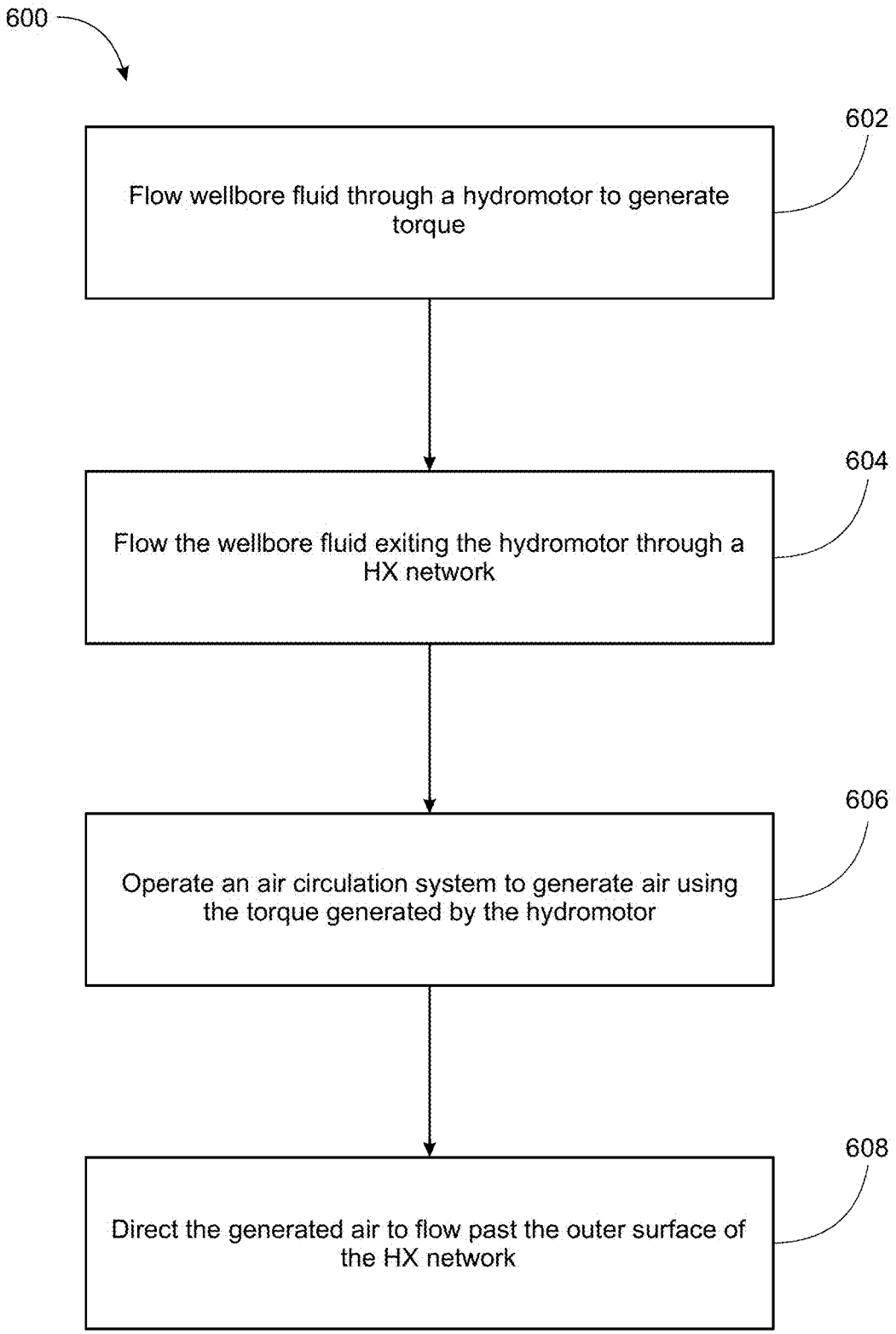
FIG. 6 is a flowchart of an example of a process of cooling wellbore fluids received from multiple wellheads.

FIG. 6 is a flowchart of an example of a process 600 of cooling wellbore fluids received from single or multiple wellheads. At 602, wellbore fluid received from a single or multiple wellhead of a wellbore is flowed through a hydromotor to generate torque. At 604, the wellbore fluid exiting the hydromotor is flowed through a HX network that includes multiple pipes that are arranged to exchange heat of the wellbore fluid with air flowed past an outer surface of the heat exchanger network. At 606, the torque generated by flowing the wellbore fluid through the hydromotor is used to operate an auxiliary air blowing system blowing systems. At 608, air is directed to flow past the outer surface of the HX network from multiple location and direction.

In some implementations, the shaft of the hydropump 206 can be connected to a generator with or without a gear box. Fluid energized by the hydropump 206 can drive the generator to produce electricity, which can be used to operate the cooling system.

EXAMPLES

Certain aspects of the subject matter described here can be implemented as a method of cooling wellbore fluids. Wellbore fluid received from a wellhead of a wellbore is flowed through a hydromotor to generate torque. The wellbore fluid exiting the hydromotor is flowed through a HX network that includes multiple pipes arranged to exchange heat of the wellbore fluid with air flowed past an outer surface of the HX network. Using the torque generated by flowing the wellbore fluid through the hydromotor, an air blowing system is operated to generate air. The generated air is flowed past the outer surface of the HX network.

An aspect combinable with any other aspect can include the following features. To operate the air blowing system using the torque and rotation generated by flowing the wellbore fluid through the hydromotor, a shaft can be coupled to the hydromotor. The shaft can be rotated with the generated torque.

An aspect combinable with any other aspect can include the following features. The air blowing system includes a fan. The shaft is coupled to the fan to generate the air.

An aspect combinable with any other aspect can include the following features. To direct the generated air to flow past the outer surface of the HX network, the fan is spatially arranged to flow the air through spaces between the multiple pipes of the HX network.

An aspect combinable with any other aspect can include the following features. The air blowing system includes a hydropump. The shaft is coupled to the hydropump to increase a flow rate of the air.

An aspect combinable with any other aspect can include the following features. Using the air blowing generated by the hydropump, multiple fans are operated. Each fan is configured to generate air flow. The multiple fans are spatially arranged to flow the generated air through spaces between the multiple pipes of the HX network.

An aspect combinable with any other aspect can include the following features. The hydropump is coupled to multiple hydromotors corresponding to the multiple fans. Each of the multiple hydromotors is coupled to a respective fan of the multiple fans. Each hydromotor of the multiple hydromotors receives a portion of the air with increased flow rate and responsively generates torque to rotate the respective fan to which each hydromotor is coupled.

An aspect combinable with any other aspect can include the following features. One of the multiple fans is coupled to a hydraulic fluid container. Oil is flowed from the hydraulic fluid container to the hydropump using air generated by one of the multiple fans.

An aspect combinable with any other aspect can include the following features. Cooled wellbore fluid exiting the HX network is flowed to flowlines configured to flow the cooled wellbore fluid to downstream facilities.

An aspect combinable with any other aspect can include the following features. The flowlines include reinforced thermoplastic pipes.

Certain aspects of the subject matter described here can be implemented as a wellbore fluid cooling system. The system includes a hydromotor fluidically coupled to a wellhead to receive wellbore fluid from a wellbore at which the wellhead is installed. The hydromotor can generate torque in response to receiving the wellbore fluid. The system includes a HX network including multiple pipes. The HX network is fluidically coupled to the hydromotor to receive the wellbore fluid exiting the hydromotor. The HX network can exchange heat of the wellbore fluid with air flowed past an outer surface of the HX network. The system includes an air blowing system coupled to the hydromotor and spatially arranged with respect to the HX network. The air blowing system can generate air and direct the generated air to flow past the outer surface of the HX network.

An aspect combinable with any other aspect can include the following features. The air blowing system includes a shaft coupled to the hydromotor. The shaft can rotate in response to the torque generated by the hydromotor.

An aspect combinable with any other aspect can include the following features. The air blowing system includes a fan coupled to the shaft to generate air in response to a rotation of the shaft.

An aspect combinable with any other aspect can include the following features. The air blowing system includes a hydropump coupled to the shaft to generate air blowing in response to a rotation of the shaft.

An aspect combinable with any other aspect can include the following features. The air blowing system includes multiple fans coupled to the hydropump. Each fan can generate air. The multiple fans are spatially arranged to flow the generated air past the outer surface of the HX network.

An aspect combinable with any other aspect can include the following features. The air blowing system includes multiple hydromotors corresponding to the multiple fans. Each hydromotor is coupled to a respective fan. Each hydromotor receives a portion of the air with the increased flow rate and responsively generating torque to rotate the respective fan to which each hydromotor is coupled.

An aspect combinable with any other aspect can include the following features. The system includes a generator coupled to the air blowing system. Generator power up through wellbore fluid energy only(fluid or gas) The generator can generate electricity using the air generated by the air blowing system. The generator can power at least some components of the air blowing system using the generated electricity.

Thus, particular implementations of the subject matter have been described. Other implementations are within the scope of the following claims.

The invention claimed is:

1. A method of cooling wellbore fluids, the method comprising:

flowing, wellbore fluid received from a wellhead of a wellbore, through a hydromotor to generate torque and rotation;

flowing the wellbore fluid exiting the hydromotor through a heat exchanger network comprising a plurality of pipes arranged to exchange heat of the wellbore fluid with air flowed past an outer surface of the heat exchanger network;

operating, using the torque and rotation generated by flowing the wellbore fluid through the hydromotor, an air blowing system to generate air;

increasing, using a hydropump included in the air blowing system, a flow rate of the air; and directing the generated air with increased flow rate to flow past the outer surface of the heat exchanger network;

wherein operating, using the torque and rotation generated by flowing the wellbore fluid through the hydromotor, the air blowing system comprises:

coupling a shaft to the hydromotor;

coupling the shaft to the hydropump to increase the flow rate of the air; and rotating the shaft with the generated torque and rotation.

2. The method of claim 1, wherein the air blowing system comprises a fan, the method further comprising coupling the shaft to the fan to generate the air.

3. The method of claim 2, wherein directing the generated air to flow past the outer surface of the heat exchanger network comprises spatially arranging the fan to flow the air through spaces between the plurality of pipes of the heat exchanger network.

4. The method of claim 1, further comprising operating, using the air blowing generated by the hydropump, a plurality of fans, each configured to generate air flow, the plurality of fans spatially arranged to flow the generated air through spaces between the plurality of pipes of the heat exchanger network.

5. The method of claim 4, further comprising coupling the hydropump to a plurality of hydromotors corresponding to the plurality of fans, each of the plurality of hydromotors coupled to a respective fan of the plurality of fans, each hydromotor of the plurality of hydromotors receiving a portion of the air with increased flow rate and responsively generating torque to rotate the respective fan to which each hydromotor is coupled.

6. The method of claim 5, wherein one of the plurality of fans is coupled to a hydraulic fluid container, wherein the method comprises flowing oil from the hydraulic fluid container to the hydropump using air generated by the one of the plurality of fans.

7. The method of claim 1, further comprising flowing cooled wellbore fluid exiting the heat exchanger network to flowlines configured to flow the cooled wellbore fluid to downstream facilities.

8. The method of claim 7, wherein the flowlines comprise reinforced thermoplastic pipes.

9. The method of claim 1, wherein the heat exchanger network comprises a plurality of heat exchangers operating in tandem.

10. A wellbore fluid cooling system comprising:

a hydromotor fluidically coupled to a wellhead to receive wellbore fluid from a wellbore at which the wellhead is installed, the hydromotor configured to generate torque in response to receiving the wellbore fluid;

a heat exchanger network comprising a plurality of pipes, the heat exchanger network fluidically coupled to the hydromotor to receive the wellbore fluid exiting the hydromotor, the heat exchanger network configured to exchange heat of the wellbore fluid with air flowed past an outer surface of the heat exchanger network; and an air blowing system coupled to the hydromotor and spatially arranged with respect to the heat exchanger network, the air blowing system comprising a hydropump configured to generate air, the air blowing system configured to direct the generated air to flow past the outer surface of the heat exchanger network;

wherein the air blowing system comprises a shaft coupled to the hydromotor, the shaft configured to rotate in response to the torque generated by the hydromotor; and wherein the hydropump is coupled to the shaft to generate air blowing in response to a rotation of the shaft.

11. The system of claim 10, wherein the air blowing system comprises a fan coupled to the shaft to generate air in response to a rotation of the shaft.

12. The system of claim 10, wherein the air blowing system comprises a plurality of fans coupled to the hydropump, each configured to generate air, the plurality of fans spatially arranged to flow the generated air past the outer surface of the heat exchanger network.

13. The system of claim 12, wherein the air blowing system comprises a plurality of hydromotors corresponding to the plurality of fans, each of the plurality of hydromotors coupled to a respective fan of the plurality of fans, each hydromotor of the plurality of hydromotors receiving a portion of the air with increased flow rate and responsively generating torque to rotate the respective fan to which each hydromotor is coupled.

14. The system of claim 10, further comprising a generator coupled to the air blowing system, the generator configured to generate electricity using the air generated by the air blowing system, the generator configured to power at least some components of the air blowing system using the generated electricity.

15. The system of claim 10, wherein the wellhead comprises a choke valve configured to control a pressure and rate of the wellbore fluids that are flowed from the wellhead to locations downstream of the wellhead, wherein the hydromotor, the heat exchanger network and the air blowing system are located downstream of the choke valve.

16. The system of claim 10, wherein the wellhead comprises a choke valve configured to control a pressure and rate of the wellbore fluids that are flowed from the wellhead to locations downstream of the wellhead, wherein the hydromotor, the heat exchanger network and the air blowing system are located upstream of the choke valve.

* * * * *